US010774643B2

(12) United States Patent
Noonan

(10) Patent No.: US 10,774,643 B2
(45) Date of Patent: Sep. 15, 2020

(54) SAFETY SYSTEM AND METHOD FOR PROTECTING AGAINST A HAZARD OF DRILL ROD FAILURE IN A DRILLED ROCK BORE

(71) Applicant: JUSAND NOMINEES PTY LTD AS TRUSTEE FOR AN & JM NOONAN FAMILY TRUST, Port Melbourne (AU)

(72) Inventor: Gerry Noonan, Parkville (AU)

(73) Assignee: JUSAND NOMINEES PTY LTD AS TRUSTEE FOR AN & JM NOONAN FAMILY TRUST, Port Melbourne (AU)

( * ) Notice: Subject to any disclaimer, the term of this patent is extended or adjusted under 35 U.S.C. 154(b) by 67 days.

(21) Appl. No.: 15/775,802

(22) PCT Filed: Nov. 11, 2016

(86) PCT No.: PCT/AU2016/051090

§ 371 (c)(1),
(2) Date: May 11, 2018

(87) PCT Pub. No.: WO2017/079808

PCT Pub. Date: May 18, 2017

(65) Prior Publication Data

US 2018/0328175 A1 Nov. 15, 2018

(30) Foreign Application Priority Data

Nov. 12, 2015 (AU) ..... 2015255248

(51) Int. Cl.
*E21F 11/00* (2006.01)
*E21B 33/12* (2006.01)
(Continued)

(52) U.S. Cl.
CPC ..... *E21F 11/00* (2013.01); *E21B 33/12* (2013.01); *E21B 7/025* (2013.01); *E21B 12/00* (2013.01); *E21D 21/0093* (2013.01)

(58) Field of Classification Search
CPC ..... E21F 11/00; E21B 33/12
See application file for complete search history.

(56) References Cited

U.S. PATENT DOCUMENTS 2,538,862 A * 1/1951 Clark ..... E21B 41/0021 166/243
6,454,012 B1 * 9/2002 Reid ..... E21B 17/07 166/242.7

(Continued)

FOREIGN PATENT DOCUMENTS

CA 624327 A 7/1961

*Primary Examiner* — Janine M Kreck
(74) *Attorney, Agent, or Firm* — Foster Garvey PC

(57) ABSTRACT

The present invention provides a safety system (1) for protecting against a hazard of a drill rod failure in a drilled rock bore (B) above horizontal, and especially a hazard posed by a broken drill rod section (S) lodged within the bore (B). The safety system (1) comprises: a plug member (2) for insertion into a proximal end region (E) of the bore (B) adjacent a rock-face (F), the plug member (2) being configured to be fixed within the proximal end region (E) of the bore (B); and an impact reduction member (5) for reducing an impact of the broken drill rod section (S) striking the plug member (2) within the proximal end region (E) of the bore (B). The impact reduction member (5) is configured to be located within the proximal end region (E) of the bore (B) and to extend within the bore (B) above the plug member (2).

28 Claims, 5 Drawing Sheets

(51) Int. Cl.

| | |
|---|---|
| *E21D 21/00* | (2006.01) |
| *E21B 7/02* | (2006.01) |
| *E21B 12/00* | (2006.01) |

(56) References Cited

U.S. PATENT DOCUMENTS

| | | | | |
|---|---|---|---|---|
| 7,967,085 | B2 | 6/2011 | Drenth | |
| 2004/0084217 | A1 | 5/2004 | Mocivnik | |
| 2009/0217482 | A1* | 9/2009 | Miyanaga | B08B 1/04 15/383 |
| 2016/0326828 | A1* | 11/2016 | Phillips | F16L 55/1141 |
| 2019/0048681 | A1* | 2/2019 | Sutton | E21B 33/122 |

* cited by examiner

SAFETY SYSTEM AND METHOD FOR PROTECTING AGAINST A HAZARD OF DRILL ROD FAILURE IN A DRILLED ROCK BORE

PRIORITY CLAIM

This application is a 35 U.S.C. § 371 National Phase of PCT Application No. PCT/AU2016/051090 filed Nov. 11, 2016; which application claims priority to Australian Application No. 2015255248 filed Nov. 12, 2015. The foregoing applications are hereby incorporated by reference in their entireties as if fully set forth herein.

FIELD OF THE INVENTION

The present invention relates to a safety system for protecting against a hazard of drill rod failure in a drilled rock bore extending above horizontal, and especially a hazard posed by a broken drill rod section lodged within a drilled rock bore. The invention also relates to a method of protecting against such a hazard of drill rod failure. Thus, it will be appreciated that the invention has particular application or use in the mining industry, although applications may also be contemplated in other fields, such as in the construction industry.

BACKGROUND OF THE INVENTION

In underground mine environments, a body or vein of ore will often be accessed by excavating cavities or working chamber (hereinafter cavity) into the rock strata below the ore body or vein and then working towards the ore deposit from below. This technique is referred to in the mining field as "overhand stoping" and has become the predominant direction of mining with the advent of rock blasting and power drills. In particular, the technique commonly involves drilling multiple bores upwards from the cavity into the rock strata towards the ore deposit above. Explosive charges are then set in the bores to blast away the intervening rock and to access the ore deposit directly. Indeed, the bores and the explosive charges may extend into the ore deposit itself, which together with the intervening rock then collapses into the cavity below for removal.

A significant problem associated with this mining technique is associated with drill rod failure when drilling the multiple bores extending upwards into the rock strata towards the ore body. The individual bores drilled are often tens of metres long (for example, in the range of 20 to 60 metres) and the drill rods which extend over that length may only have a diameter of about 80 millimetres. As the composition and properties of the rock strata will typically vary through its depth, the drill rods are subjected to varying and also somewhat unpredictable loading during the drilling of each bore. Perhaps not surprisingly, therefore, the failure or breakage of a drill rod is not uncommon when the multiple bores are being drilled to lay the explosive charges. This has the problem that a section of drill rod, which may, for example, be fifteen or twenty metres long with a mass in the range of 100 kg to 500 kg, is left lodged in the bore extending upwards from the cavity. The pressure produced by the rock strata can alter either naturally, or as a result of further drilling of adjacent holes. This can result in the broken drill rod dislodging from the bore hole and falling into the cavity. It is therefore not difficult to imagine that the hazard posed to personnel and/or to equipment by such a massive broken drill rod section, which could unexpectedly drop out of the bore, is extreme.

In the event of such a drill rod failure in a bore extending above horizontal (where the risk of the broken drill rod section dropping out exists), occupational health and safety regulations in many countries require the affected bore to be covered and/or otherwise rendered safe before work in that particular area may continue. In the absence of a tailored solution to this problem to date, however, miners have had to improvise with very provisional and suboptimal measures. These have not only been extremely time-consuming, leading to long delays in the further progress of the mining, but the real safety provided by such provisional measures has at times also been questionable.

SUMMARY OF THE INVENTION

In view of the above, it is an object of the present invention to provide a new and improved safety system and an associated method for protecting against a hazard of drill rod failure in a drilled rock bore extending above horizontal, and especially for protecting against the hazard of a broken drill rod section falling out of the bore into an excavated cavity area.

According to one aspect, therefore, the present invention provides a safety system for protecting against a hazard of drill rod failure in a drilled rock bore above the horizontal, especially a hazard posed by a broken drill rod section within the bore, the safety system comprising:

- an anchor member configured to be fixed in a proximal end region of the drilled bore adjacent a rock-face; and
- an impact reduction member for reducing an impact of a drill rod section striking the anchor member in the proximal end region of the drilled bore, wherein the impact reduction member is configured to be located within the proximal end region of the bore and to extend within the bore above the anchor member.

Thus, the safety system of the invention is configured and arranged to be fixed at the proximal end region of the bore adjacent the rock-face and to absorb the force or impact of a broken drill rod section falling within the bore towards the opening in the rock-face. Further, the safety system desirably prevents such a broken drill rod section from falling out into the space or area in which the work is taking place. In this way, the safety system is able to protect the area in which workers and/or equipment may still be active in further mining operations from the hazard of a drill rod section falling from a drilled bore in which the drill rod has suffered a failure and broken or sheared off within the bore.

In an embodiment of the safety system, the anchor member is configured to plug into the drilled bore and at least partially block or obscure the bore. In this way, the anchor member may form a plug member which is configured and arranged to at least partially block or close a proximal end region of the bore against the hazard of the broken drill rod section falling out into the area in which workers and/or equipment may be active in further mining operations or other activities.

According to an embodiment, therefore, the invention provides a safety system for protecting against a hazard of drill rod failure in a drilled rock bore which extends above horizontal, especially a hazard posed by a broken drill rod section within the bore, the safety system comprising:

- a plug member for insertion into a proximal end region of the drilled bore adjacent or proximate a rock-face, the plug member being configured to be fixed within the proximal end region of the bore; and an impact reduction member for reducing an impact of the broken drill rod section striking the plug member in the proximal end region of the bore, wherein the impact reduction member is configured to be located within the proximal end region of the bore and to extend within the bore above the plug member.

In an embodiment of the safety system, the plug member is configured to be fixed within the proximal end region of the drilled bore in a friction fit or interference fit. In this regard, the plug member may, for example, comprise a split tube having a longitudinal slit or gap and an outer diameter sized larger than an inner diameter of the drilled bore. The split tube is configured to be driven into the proximal end region of the drilled bore and the longitudinal slit or gap is thus configured to allow the outer diameter of the split tube (i.e. of the plug member) to be compressed or to reduce when the plug member is driven into the drilled bore of smaller diameter. In this way, the plug member comprising the split tube can be fixed in the proximal end region of the bore adjacent the rock-face in a friction fit or an interference fit, in a manner similar to that known for a "split-set" type of rock anchor. The plug member is thereby configured to at least partially close or block the drilled bore. To assist insertion of the plug member into the proximal end region of the drilled bore, the plug member (split tube member) preferably has a front or leading end region of a reduced diameter smaller than an inner diameter of the drilled bore.

In an embodiment of the safety system, the impact reduction member comprises a tapered portion for a gradual or extended transfer of an impact loading imparted by a falling drill rod section to the plug member. In this regard, the impact reduction member is configured and arranged to be impacted or struck directly by the falling drill rod section, and the tapered portion is configured to allow movement of the impact reduction member relative to the plug member for gradual or extended transfer of the impact loading from the drill rod section to the plug member. By the gradual or extended transfer of the impact loading to the plug member, the impact force can be significantly reduced. In this regard, the stopping distance for a falling object (i.e. the distance travelled by the object after initial impact) has a profound effect on the impact force imparted. Specifically, the larger the stopping distance, the lower the impact force by virtue of an inversely proportional relationship; i.e. by doubling the stopping distance, the impact force can effectively be halved. For this reason, the tapered portion of the impact reduction member is desirably configured and arranged to provide for movement of the falling drill rod section relative to the plug member for gradual or extended transfer of the impact loading from the drill rod section to the plug member.

In an embodiment of the system, the impact reduction member is configured for movement into an interior of the anchor member or the plug member when it is impacted or struck by the drill rod section.

In an alternative embodiment of the system, the tapered portion is configured and arranged to allow movement of the drill rod section relative to the impact reduction member. In this regard, the tapered portion of the impact reduction member may be fixed relative to the anchor member or the plug member.

In an embodiment, the safety system further comprises an adapter member which is configured for connection to a rock drilling apparatus for driving or inserting the safety system, especially the plug member and the impact reduction member, into the proximal end region of the drilled bore. In this way, the safety system may be designed to operate with the same equipment used for drilling the bores. This is particularly helpful because no new or additional equipment is required to deploy the safety system of the invention, resulting in minimal disruption and minimal time loss. Rather, the operator is able to continue working with the same equipment and use that equipment to secure the compromised bore with the broken drill rod section by introducing or inserting the safety system. The adapter member may, for example, be configured to cooperate with and/or to be received in a drill rod carousel of the rock drilling apparatus. This thereby enables the safety system to be placed in and held by the drill rod carousel and then be introduced or inserted (e.g. driven or forced) into the proximal end region of the bore by the rock drilling apparatus.

In an embodiment, the adapter member includes a collar against which the plug member seats such that the collar is configured to impart or transfer an axial force to the plug member to drive the plug member into the proximal end region of the drilled bore in a friction fit or interference fit. Preferably, the tapered portion of the impact reduction member is connected to, and optionally integrally formed with, the adapter member.

In an embodiment of the safety system, the impact reduction member comprises an impact dampening material which is introduced into the drilled bore above the anchor member or the plug member. In this way, the impact dampening material may serve to physically fill and block or obscure part of the proximal end region of the bore, and also to provide an impact dampening effect. The impact dampening material may, for example, comprise a polymer foam material which can preferably be introduced or injected into the drilled bore in a liquid or fluid form. The polymer foam then preferably solidifies within the bore and serves not only to physically fill and block or obscure part of the proximal end region of the bore, but also provides an impact dampening effect. The impact dampening material may also comprise sand or a similar material, for introduction or injection into the bore above the anchor member or the plug member.

According to another aspect, the present invention provides a method of protecting against a hazard of drill rod failure in a drilled rock bore which extends above horizontal, especially a hazard posed by a broken drill rod section in the bore, the method comprising:

fixing an anchor member in or at a proximal end region of the drilled bore to at least partially plug or obscure the proximal end region of the bore adjacent to or in the vicinity of a rock-face; and reducing an impact of a broken drill rod section striking the anchor member within the proximal end region of the bore.

In an embodiment of the inventive method, the step of fixing the anchor member in or at a proximal end region of the bore comprises inserting an over-sized split tube into the proximal end region of the bore, e.g. by driving or forcing the split tube into the bore, in a friction fit or an interference fit. Preferably this includes driving the split tube beyond the rock face in the bore to reach competent rock.

In an embodiment of the method, the step of reducing the impact of the broken drill rod section striking the anchor member comprises: arranging an impact reduction member within the proximal end region of the bore above the anchor member. Preferably, the impact reduction member comprises a tapered portion for gradual or extended transfer of the impact loading from the falling drill rod section to the anchor member.

According to further still another aspect of this invention there is provided a safety system for protecting against a hazard of a drill rod failure in a drilled rock bore above horizontal, and especially a hazard posed by a broken drill rod section lodged within the bore, the safety system comprising:

a plug member for insertion into a proximal end region of the bore (B) adjacent a rock-face, the plug member being configured to be fixed within the proximal end region of the bore; and an impact reduction member for reducing an impact of the drill rod section on the plug member, wherein the impact reduction member is configured to be located within the proximal end region of the bore and to extend within the bore above the plug member for striking the plug member within the proximal end region of the bore when impacted by the drill rod.

In a preferred embodiment the plug member is in the form of a tube having an outer diameter, and a leading end region of a reduced diameter for assisting introducing the plug member into the bore. More preferably the tube is in the form of a split tube that has a longitudinally extending split which allows the outer diameter of the tube to reduce when the plug member is driven into the bore.

In another preferred embodiment the impact reduction member includes an elongate body which is arranged substantially centrally of the plug member, and configured to be movable relative to the plug member when impacted by the drill rod section. Preferably the elongate body includes a tapered portion which exerts an outward force on the plug member when the elongate body moves on impact by the drill rod section.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference signs designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will also be understood that certain actions and/or steps in an embodiment of a method may be described or depicted in a particular order of occurrences while those skilled in the art will understand that such specificity with respect to sequence is not actually required.

DETAILED DESCRIPTION OF EMBODIMENTS

Figure 1:
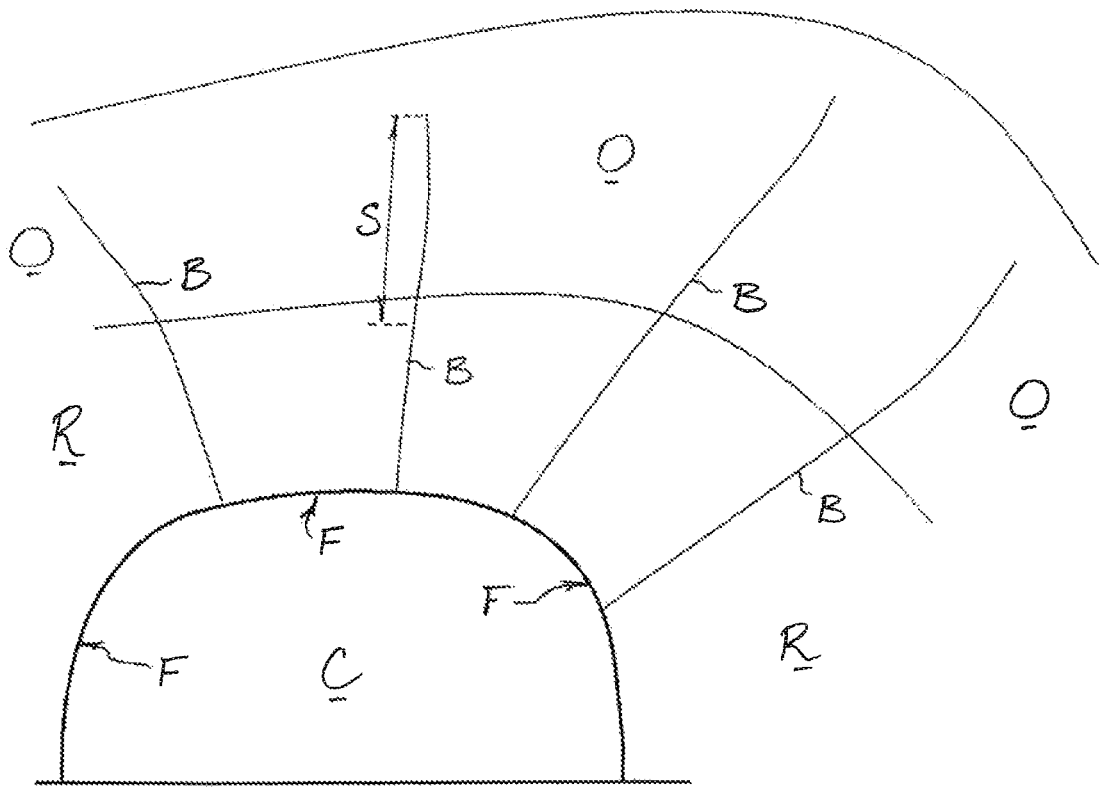
FIG. 1 is a schematic cross-sectional view of an excavated cavity in a mine environment illustrating bores drilled in rock strata extending towards an ore deposit.

With reference firstly to FIG. 1 of the drawings, a cross-sectional view of a mine environment is illustrated schematically. An excavated cavity or chamber C of the mine is shown in a cross-section taken normal or transverse to a length of that cavity or chamber C into the page. The cavity C is essentially surrounded by rock strata R and an ore deposit O above the cavity C can also be seen. To access the ore deposit O, the cavity C is excavated into the rock strata R below that body or vein of ore O and then multiple bores B are drilled upwards from the cavity C into the rock strata R towards the ore deposit O above. In this way, explosive charges can be set in the bores B to blast away the intervening rock, which together with the ore deposit O then collapses into the cavity C below for collection and removal for processing.

When drilling the multiple bores B upwards into the rock strata R towards the ore body O, the individual bores drilled are often tens of metres long (e.g. in the range of 20 to 60 metres) and the drill rods (not shown) which extend over that length may have a diameter of about 80 millimetres. As the composition and properties of the rock strata R typically varies through its depth, and in any case in comparison to the composition and properties of the ore deposit O, the drill rods are subjected to varying and unpredictable loading during the drilling of each bore B. Failure or breakage of a drill rod is not uncommon when multiple bores B are being drilled to lay the explosive charges above the cavity C. Thus, a section S of drill rod, which may, for example, be 20 or 30 metres long with a mass in the range of 100 kg to 500 kg, may be left in the bore B extending above the cavity C presenting a major hazard to personnel and/or equipment in the cavity C, as this massive broken drill rod section S could unexpectedly fall out of the bore B.

Figure 2:
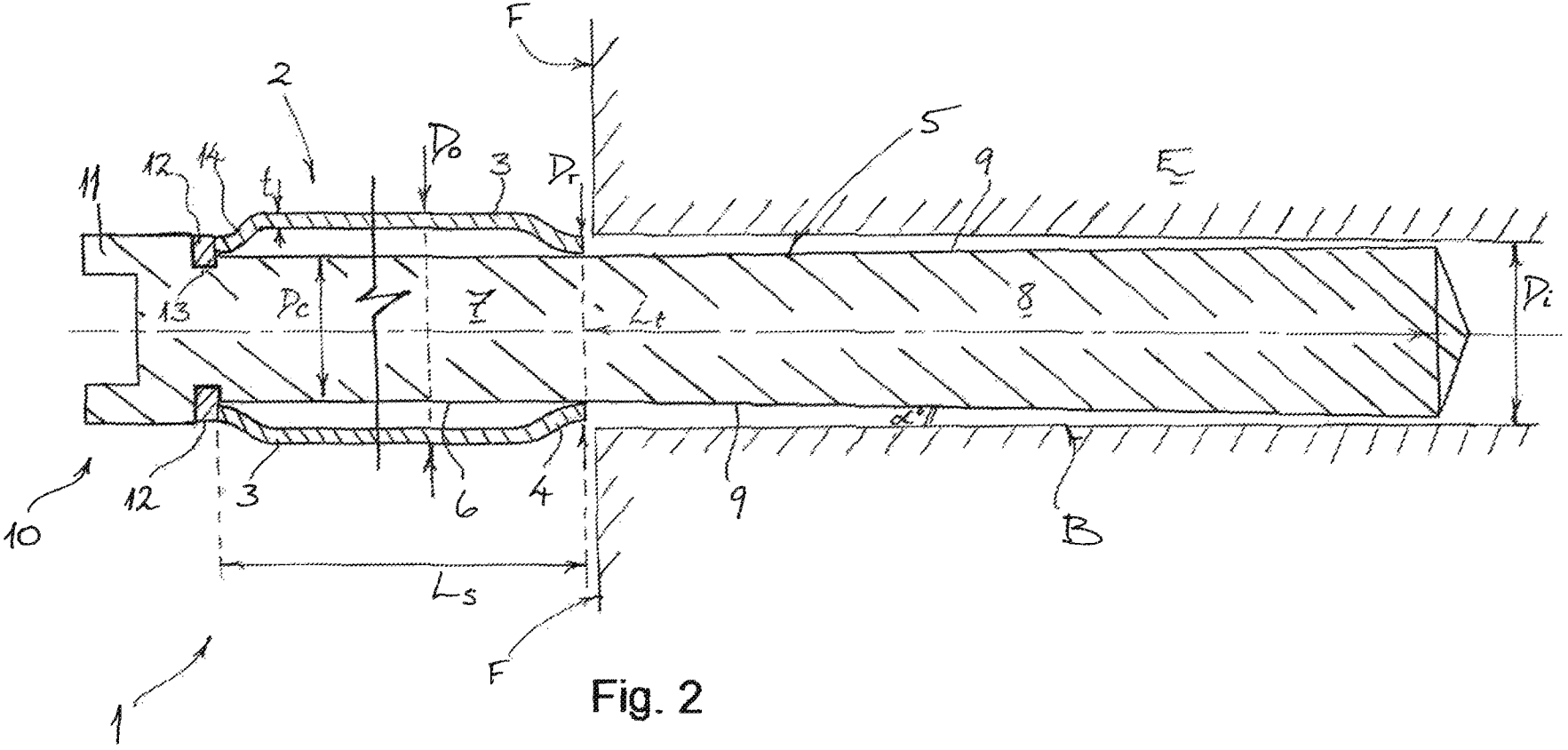
FIG. 2 is a schematic cross-sectional side view of a safety system to protect against the hazard of a broken drill rod section in a drilled rock bore according to an embodiment of the invention.
Figure 3:
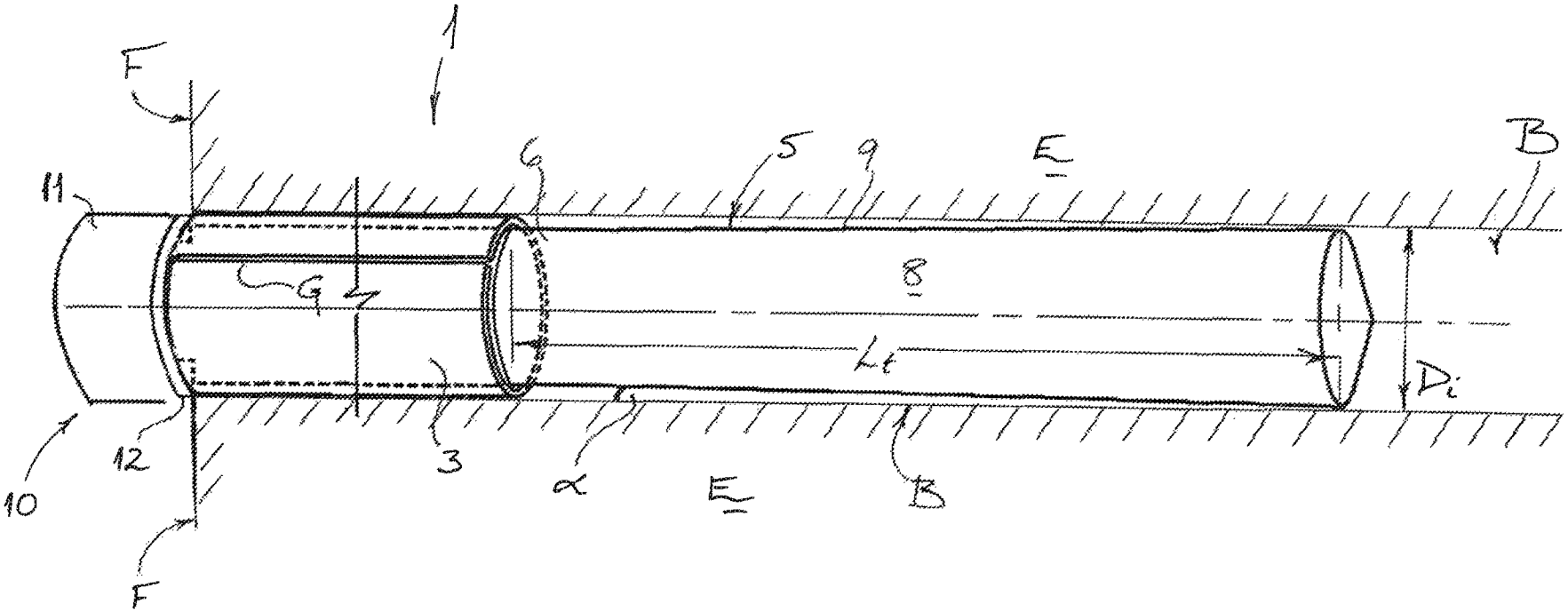
FIG. 3 is a schematic partial perspective view of the safety system of FIG. 2 shown in an installed state in a proximal end region of a bore.

With reference now to FIGS. 2 and 3 of the drawings, a safety system 1 according to a preferred embodiment for protecting against just such a hazard posed by the broken drill rod section S in the drilled bore B is shown schematically. The safety system 1 comprises an anchor member 2, which is configured to be inserted and fixed in a proximal end region E of the bore B adjacent or close to a rock-face F of the cavity C at which the drilling takes place. The anchor member 2 is provided in the form of a plug member which is configured to be driven into and fixed within the proximal end region E of the drilled bore B in a friction fit or interference fit. In this regard, the plug member 2 comprises a split tube 3 formed from a round steel tube or pipe having an outer diameter Do sized larger than an inner diameter Di of the bore B. For example, if the bore B has an inner diameter Di of 89 mm, the split tube 3 may have an outer diameter Do of about 100 mm and a wall thickness t of about 6 mm to 9 mm, e.g. about 8 mm in this case. Furthermore, the split tube 3 has a longitudinally extending slit or gap G formed or cut in the wall (as seen in FIG. 3) which allows the outer diameter Do of the split tube 3 (i.e. plug member 2) to be compressed or to reduce when the plug member 2 is driven into the drilled bore B of smaller diameter Di. A front or leading end region 4 of the split tube 3 also has a reduced diameter Dr that is smaller than an inner diameter Di of the drilled bore B to assist the initial introduction or insertion of the plug member 2 into the proximal end region E of the bore B. In this way, the plug member 2 comprised of the split tube 3 can be fixed in the proximal end region E of the bore B adjacent the rock-face F in a friction fit, in a manner similar to that known for a "split-set" type of rock anchor. As with the other dimensions of the split tube 3, the length Ls of the split tube 3 may be selected as appropriate to the rock-strata R, but it is preferably in the range of about 400 mm to 800 mm; e.g. 600 mm in this case.

The safety system 1 further comprises an impact reduction member 5 for reducing an impact of the broken drill rod section S in the event that it falls and strikes the anchor member or plug member 2 in the proximal end region E of the bore B. The impact reduction member 5 is also arranged in the proximal end region E of the bore B and extends within the bore B above the anchor or plug member 2. In this embodiment, the impact reduction member 5 comprises an elongate body 6 which is arranged centrally of the plug member 2 and which is configured and arranged to be impacted or struck directly by the broken drill rod section S, in the event that the broken drill rod section S falls within the bore B. The elongate body 6 may be formed of steel (e.g. mild steel) and may be machined from bar stock with a round cross-section. A portion 7 of the elongate body 6 within the split tube 3 preferably has a substantially constant diameter Dc and a portion 8 of the elongate body 6 extending above the split tube 3 is tapered, i.e. an outer surface 9 of the elongate body 6 in the tapered portion 8 tapers outwardly at an angle $\alpha$ of about 1° to 3°; e.g. about 1° in this case. The length Lt of the tapered portion 8 may be selected as appropriate to the safety system, but this length is preferably in the range of about 200 mm to 400 mm; e.g. 290 mm in this case, with the tapered portion 8 tapering from a maximum diameter of about 80 mm at its distal end to a diameter of about 70 mm at the constant diameter portion 7 within the split tube 3.

In this embodiment, the impact reduction member 5 is configured for movement relative to the plug member 2 upon impact by the falling broken drill rod section S. That is, the body 6 of the impact reduction member 5 is configured for movement into an interior of the plug member 2 if impacted or struck by the drill rod section S. In this way, the outer surface 9 of the tapered portion 8 of the body 6 contacts and bears against an inner surface of the split tube 3. As an initial impact by the broken drill rod section S drives the elongate body 6 downwards into the split tube 3, the slight taper of the tapered portion 8 exerts an outward force on the split tube 3 and thus enhances or increases engagement between the bore B and the tube 3. The tapered portion 8 thereby acts to effect a gradual or extended transfer of impact loading from the broken drill rod section S to the plug member 2. In particular, by extending the stopping distance for the falling drill rod section S (i.e. the distance travelled by the drill rod section S after initial impact) via the tapered portion 8, the impact force is reduced significantly, such that the friction fit or interference fit of the anchor member or plug member 2 within the bore B can readily withstand the impact loading. In this way, the safety system 1 of this embodiment can effectively and reliably protect workers and/or equipment in the cavity C from the hazard of broken drill rod sections S falling from a bore B drilled above horizontal.

To facilitate deployment of the safety system 1 described above, the safety system 1 may include an adapter member 10 configured to cooperate with a rock drilling apparatus (not shown) for introducing the plug member 2 and the impact reduction member 5, into the proximal end E of the bore B. The adapter member 10 may, for example, be configured to be received in a drill rod carousel of the rock drilling apparatus. This enables the safety system 1 to be placed in and held by the drill rod carousel and then introduced or inserted (e.g. hydraulically driven or forced) into the proximal end region E of the bore B by the rock drilling apparatus. To this end, the adapter 10 may include a head 11 configured for connection with the rock drilling apparatus. Furthermore, the adapter member 10 may be connected to, and preferably integrally formed with, the body 6 of the impact reduction member 5. The adapter member 10 further includes a collar 12 which sits within and engages a corresponding groove or slot 13 in the adapter member 10. The split tube 3 of the plug member 2 seats against the collar 12, such that the collar 12 imparts an axial force to the plug member 2 to drive the plug member 2 (together with impact reduction member 5) into the proximal end E of the drilled bore B in a friction fit. As is apparent from FIG. 2, the collar 12 preferably has an outer diameter slightly less than the inner diameter Di of the bore B and a rear or trailing end region 14 of the split tube 3 which abuts and seats against the collar 12 is also swaged inwards to a reduced diameter Dr, i.e. like the front or leading end region 4. This configuration enables the anchor member 2 and the impact reduction member 5 of the safety system 1 to be driven into the drilled bore B beyond the rock face F. This may be particularly useful where the rock at the rock face F is friable or crumbing, because it enables the safety system 1 to be driven deeper into the bore B beyond the rock face F where it can be soundly founded in competent rock.

Figure 4:
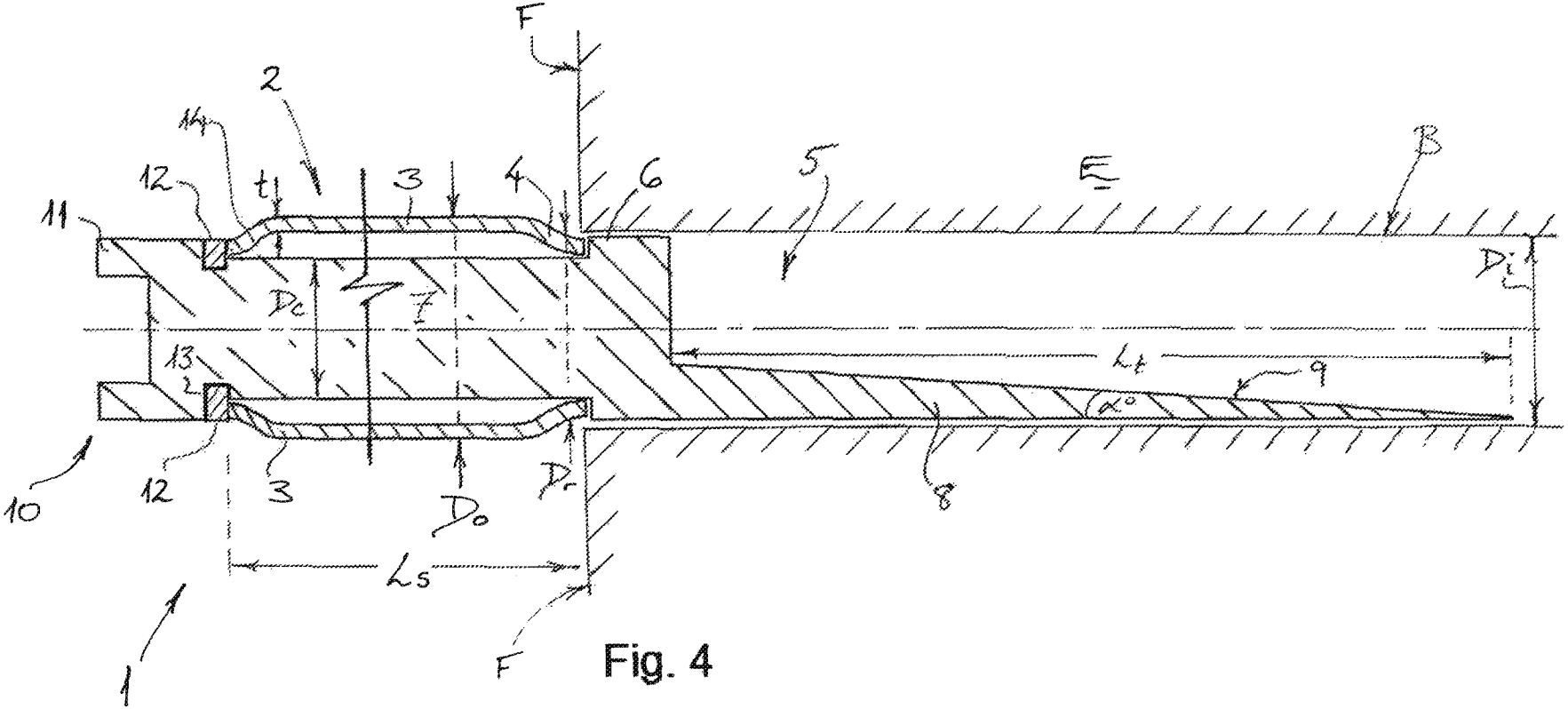
FIG. 4 is a schematic cross-sectional side view of a safety system to protect against the hazard of a broken drill rod section in a drilled rock bore according to another embodiment of the invention.

With reference now to drawing FIG. 4, another embodiment of a safety system 1 is shown and like parts are designated with like or corresponding reference signs compared with the embodiment of FIGS. 2 and 3. In this embodiment, the safety system 1 again includes a plug type anchor member 2 comprising a split tube 3 having longitudinally extending slit or gap (not shown) and a front or leading end region 4 of reduced diameter Dr to assist driven or forced insertion into a proximal end region E of a bore B in an interference fit or a friction fit. The safety system 1 furthermore again includes an impact reduction member 5 comprising an elongate body 6 arranged within the plug member 2. The body 6 may again be formed of steel (e.g. mild steel) and may be machined from bar stock with a round cross-section. A portion 7 of the body 6 within the split tube 3 may have a substantially constant diameter Dc and a portion 8 of impact reduction member 5 which extends above the split tube 3 is tapered; that is, a surface 9 of the tapered portion 8 tapers at an angle $\alpha$ of about 3° to 8°, e.g. about 5° in this case, such that the tapered portion 8 forms an elongate wedge that tapers along its length Lt towards an inner periphery of the bore B.

The impact reduction member 5 is again configured and arranged to be impacted or struck directly by the broken drill rod section S, in the event that the broken drill rod section S falls within the bore B. Specifically, in this embodiment, the wedge surface 9 of the tapered portion 8 is configured and arranged to be impacted or struck directly by the broken drill rod section S. In this embodiment, however, the impact reduction member 5 is not configured for any significant movement relative to the plug member 2 upon impact by the falling broken drill rod section S. Rather, as the falling broken drill rod section S initially impacts or contacts the surface 9 of the tapered portion 8, the drill rod section S is gradually deflected towards and into contact with the opposite inner wall of the bore B. This contact generates friction which acts to brake the falling object and dissipate the impact. Again, therefore, the tapered portion 8 acts to cause gradual or extended transfer of impact loading from the drill rod section S to the anchor member 2. In particular, by extending the stopping distance for the falling drill rod section S (i.e. the distance travelled by the drill rod section S after initial impact) via the tapered portion 8, the impact force is again reduced significantly, such that the friction fit or interference fit of the anchor member 2 within the bore B can readily withstand the impact loading. The safety system 1 of this embodiment may thus also effectively and reliably protect workers and/or equipment in the cavity C from the hazard of a broken drill rod section S. As before, the safety system 1 of FIG. 4 includes an adapter member 10 configured to cooperate with a rock drilling apparatus (not shown) for deploying the plug-like anchor member 2 and the impact reduction member 5 into the proximal end E of the bore B.

Figure 5:
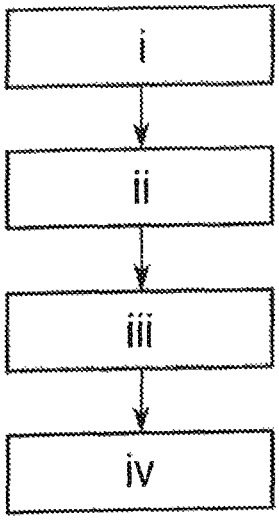
FIG. 5 is a flow diagram which schematically represents a method according to an embodiment of the invention.

Finally, referring to FIG. 5 of the drawings, a flow diagram is shown that illustrates schematically the steps in a method of protecting against a hazard resulting from drill rod failure, particularly the hazard posed by a broken drill rod section S falling out of an upwardly drilled rock bore B, according to the embodiments of the invention described above with respect to FIGS. 1 to 4. In this regard, the first box i of FIG. 5 represents the step of providing a safety system 1 according to any one of the embodiments of the invention described above. The second box ii then represents the step of fixing an anchor member 2 of the safety system 1 within the proximal end region E of the bore B to at least partially plug or block the proximal end region E of the bore B adjacent or near an outer rock-face F. The third box iii represents the step of arranging an impact reduction member 5 within the proximal end region E of the bore B above the anchor member 2. In this regard, it will be appreciated by persons skilled in the art that steps represented by boxes ii and iii in FIG. 5 may occur simultaneously or in reverse order. The final box iv in FIG. 5 of the drawings represents the step of reducing an impact of a drill rod section S striking the plug member 2 within the proximal end E of the drilled bore B via the impact reduction member 5.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 safety system
2 anchor member or plug member
3 split tube
4 front or leading end region of split tube
5 impact reduction member
6 elongate body
7 constant diameter portion of elongate body
8 tapered portion
9 outer surface of tapered portion
10 adapter member
11 head of adapter member
12 collar
13 groove or slot
14 rear or trailing end region of split tube
C cavity or chamber
R rock strata
O ore deposit or ore body
F rock-face
B bore
S broken drill rod section
E proximal end region of bore
t wall thickness of split tube
G longitudinal slit or gap
Di inner diameter of bore
Do outer diameter of split tube
Dr reduced diameter of leading and/or trailing end region of split tube
Ls length of split tube
Lt length of tapered portion
$\alpha$ taper angle

The invention claimed is:

1. A safety system for protecting against a hazard of a drill rod failure in a drilled rock bore above horizontal, namely a hazard posed by a broken drill rod section within the bore, comprising:

an anchor member configured to be fixed in a proximal end region of the bore adjacent or proximate to a rock-face wherein the anchor member is configured to at least partially block or obscure the drilled bore; and an impact reduction member which reduces an impact of the broken drill rod section striking the anchor member in the proximal end region of the bore, wherein the impact reduction member is configured to be located in the proximal end region of the drilled bore and to extend within the bore above the anchor member to be impacted or struck directly by the drill rod section falling within the bore.

2. A safety system according to claim 1, wherein the anchor member is configured to fit or plug into the drilled bore and comprises or forms a plug member.

3. A safety system according to claim 1, wherein the anchor member is configured to be fixed within the proximal end region of the bore in a friction fit or an interference fit.

4. A safety system according to claim 1, wherein the anchor member comprises a split tube having a longitudinal slit or gap and an outer diameter larger than an inner diameter of the drilled bore, wherein the anchor member is configured to be driven into the proximal end region of the bore and wherein the longitudinal slit or gap is configured to allow the outer diameter of the split tube to reduce or to be compressed when the anchor member is driven into the bore.

5. A safety system according to claim 4, wherein the anchor member has a front or leading end region of a reduced diameter which is smaller than an inner diameter of the drilled bore for assisting introduction or insertion of the anchor member into the proximal end region of the bore.

6. A safety system according to claim 1, wherein the impact reduction member comprises a tapered portion for effecting a gradual or extended transfer of an impact loading imparted from the falling drill rod section to the anchor member.

7. A safety system according to claim 6, wherein the tapered portion is configured to allow movement of the impact reduction member relative to the anchor member which effects the gradual or extended transfer of the impact loading from the drill rod section to the anchor member.

8. A safety system according to claim 7, wherein the impact reduction member is configured for movement into an interior of the anchor member when impacted or struck by the falling drill rod section.

9. A safety system according to claim 6, wherein the tapered portion is configured and arranged to provide for movement of the drill rod section relative to the anchor member for effecting the gradual or extended transfer of the impact loading from the drill rod section to the anchor member.

10. A safety system according to claim 6, wherein the tapered portion is configured to allow movement of the drill rod section relative to the impact reduction member, and/or wherein the tapered portion is fixed relative to the anchor member.

11. A safety system according to claim 1, comprising an adapter member configured for connection to a rock drilling apparatus for driving the anchor member and the impact reduction member into the proximal end of the bore.

12. A safety system according to claim 11, wherein the adapter member includes a collar against which the anchor member seats such that the collar is configured to impart an axial force to the anchor member to drive the anchor member into the proximal end of the drilled bore in a friction fit or an interference fit.

13. A safety system according to claim 11, wherein the tapered portion of the impact reduction member is connected to the adapter member.

14. A method of protecting against a hazard of drill rod failure in a drilled rock bore above horizontal, namely a hazard posed by a broken drill rod section within the bore, comprising:

fixing an anchor member at or in a proximal end region of the bore to at least partially plug or block the said proximal end region of the bore adjacent or near a rock-face; and reducing an impact of a broken drill rod section striking the anchor member within the proximal end of the drilled bore;

wherein the step of reducing an impact of a broken drill rod section striking the anchor member comprises arranging an impact reduction member within the proximal end region of the bore above the anchor member for effecting gradual or extended transfer of an impact loading from the falling drill rod section to the anchor member.

15. A method according to claim 14, wherein the step of fixing the anchor member at or in the proximal end region of the bore includes driving or forcing the anchor member into the bore in a friction fit or an interference fit.

16. A method according to claim 15, including driving the anchor member beyond the rock face in the bore to reach competent rock.

17. A method according to claim 14, wherein the impact reduction member comprises a tapered portion for effecting gradual or extended transfer of impact loading from the falling drill rod section to the anchor member.

18. A safety system for protecting against a hazard of a drill rod failure in a drilled rock bore above horizontal, namely a hazard posed by a broken drill rod section lodged within the bore, the safety system comprising:

a plug member for insertion into a proximal end region of the bore adjacent a rock-face, the plug member being configured to be fixed within the proximal end region of the bore to at least partially plug or block the proximal end region of the bore; and an impact reduction member comprising a tapered portion for reducing an impact of the broken drill rod section on the plug member, wherein the impact reduction member is configured to be located within the proximal end region of the bore and to extend within the bore above the plug member to be impacted or struck directly by the broken drill rod section falling within the bore, wherein the tapered portion is configured to allow movement of the impact reduction member relative to the plug member within the proximal end region of the bore when impacted or struck by the falling drill rod section for effecting a gradual or extended transfer of impact loading imparted from the falling drill rod section to the plug member.

19. A safety system according to claim 18, wherein the plug member is in the form of a tube having an outer diameter, and a leading end region of a reduced diameter for assisting introducing the plug member into the bore.

20. A safety system according to claim 19, wherein the tube is in the form of a split tube that has a longitudinally extending split which allows the outer diameter of the tube to reduce when the plug member is driven into the bore.

21. A safety system according to claim 18, wherein the impact reduction member comprises an elongate body which is arranged substantially centrally of the plug member, and is configured to be movable relative to the plug member when impacted or struck by the drill rod section.

22. A safety system according to claim 21, wherein the elongate body includes the tapered portion which exerts an outward force on the plug member when the elongate body moves on impact by the drill rod section.

23. A safety system for protecting against a hazard of drill rod failure in a drilled rock bore that extends above horizontal, namely a hazard posed by a broken drill rod section within the bore, comprising:

an anchor member configured to be fixed in a proximal end region of the bore adjacent or proximate to a rock-face, wherein the anchor member is configured to at least partially block or obscure the drilled bore;

an impact reduction member comprising a tapered portion for reducing an impact of the broken drill rod section striking the anchor member in the proximal end region of the bore, wherein the impact reduction member is configured to be located in the proximal end region of the bore and to extend within the bore above the anchor member to be impacted or struck directly by the broken drill rod section falling within the bore, wherein the tapered portion is configured to allow movement of the falling drill rod section relative to the anchor member to effect a gradual or extended transfer of the impact loading from the broken drill rod section to the anchor member; and wherein the safety system is configured to be deployed by driving or forcing the anchor member and the impact reduction member into the proximal end region of the bore.

24. A safety system according to claim 23, wherein the anchor member forms a plug member and is configured to be driven or forced into the proximal end region of the bore by the rock drilling apparatus, and wherein the tapered portion of the impact reduction member is configured to allow movement of the impact reduction member relative to the anchor member to effect the gradual or extended transfer of the impact loading from the drill rod section to the anchor member.

25. A safety system according to claim 23, wherein the tapered portion, in use, extends within the bore above the anchor member to be impacted or struck directly by the broken drill rod section falling within the bore, and wherein the tapered portion tapers to a tip above the anchor member.

26. A safety system according to claim 25, wherein the tapered portion is configured to allow movement of the drill rod section relative to the impact reduction member to effect the gradual or extended transfer of impact loading from the broken drill rod section to the anchor member.

27. A safety system according to claim 23, wherein the safety system comprises an adapter member configured to cooperate with and/or to be received in the rock drilling apparatus for driving the safety system into the proximal end region of the bore.

28. A safety system for protecting against a hazard of drill rod failure in a drilled rock bore above horizontal, namely a hazard posed by a broken drill rod section within the bore, comprising:

an anchor member configured to be fixed in a proximal end region of the bore adjacent or proximate to a rock-face, wherein the anchor member is configured to plug into the drilled bore and to at least partially block or obscure the drilled bore; and an impact reduction member comprising an impact dampening material for reducing an impact of the broken drill rod section striking the anchor member in the proximal end region of the bore, wherein the impact reduction member is configured to be located in the proximal end region of the drilled bore and to extend within the bore above the anchor member, wherein the impact dampening material is configured to absorb a force or impact of the broken drill rod section falling within the bore to provide an impact dampening effect.

* * * * *